US007444786B2

(12) United States Patent
Morgenstern

(10) Patent No.: US 7,444,786 B2
(45) **Date of Patent: *Nov. 4, 2008**

(54) CAST LOG STRUCTURE

(75) Inventor: Richard C. Morgenstern, Frenchtown, MT (US)

(73) Assignee: Concrete Log Systems, Inc., Missoula, MT (US)

( * ) Notice: Subject to any disclaimer, the term of this patent is extended or adjusted under 35 U.S.C. 154(b) by 851 days.

This patent is subject to a terminal disclaimer.

(21) Appl. No.: 10/887,596

(22) Filed: Jul. 9, 2004

(65) Prior Publication Data

US 2005/0000176 A1 Jan. 6, 2005

Related U.S. Application Data

(63) Continuation-in-part of application No. 09/953,678, filed on Sep. 15, 2001, now Pat. No. 6,851,233.

(51) Int. Cl.
*E04B 1/10* (2006.01)

(52) U.S. Cl. ..... 52/233; 52/405.1; 52/309.17; 52/426; 52/378

(58) Field of Classification Search ..... 52/233, 52/405.1, 426, 407.5, 604, 309.17, 378, 379, 52/562, 428

See application file for complete search history.

(56) References Cited

U.S. PATENT DOCUMENTS 1,574,636 A * 2/1926 Sutiter ..... 249/36
1,925,103 A * 9/1933 Loftus et al. ..... 52/408
3,462,905 A * 8/1969 Mordchelles-Regnier et al. ..... 52/405.1
3,552,079 A 1/1971 Mortensen
3,902,296 A * 9/1975 Thomas ..... 52/747.12
4,288,954 A 9/1981 O'Donnell
4,344,263 A * 8/1982 Farmont ..... 52/233
4,356,676 A * 11/1982 Hauptman ..... 52/396.04
4,433,519 A 2/1984 Jenkins
4,503,648 A 3/1985 Mahaffey
4,936,062 A * 6/1990 Golston et al. ..... 52/127.1
5,163,259 A 11/1992 Hunsaker et al.
5,349,798 A * 9/1994 Gross ..... 52/405.1
5,519,973 A 5/1996 Keith et al.
5,782,050 A * 7/1998 Boeshart ..... 52/426
5,802,792 A * 9/1998 Fielding et al. ..... 52/396.09
6,266,934 B1 * 7/2001 Houseal ..... 52/233
6,272,802 B1 * 8/2001 Berberich ..... 52/233
6,851,233 B2 * 2/2005 Morgenstern ..... 52/233

* cited by examiner

*Primary Examiner*—Basil Katcheves
(74) *Attorney, Agent, or Firm*—Jean Kyle

(57) ABSTRACT

A structural system includes a plurality of pre-cast structural elements. Each of the elements includes an interior layer, and an exterior layer cast of a cementitious material, an insulating layer lies between the interior layer and the exterior layer. The pre-cast structural elements are stacked adjacent one another to form a wall. A respective cushion is placed between adjacent structural elements. The cushions create airspaces such that there is no direct surface contact between adjacent structural elements. Poured grout sleeves tie one structural element to another creating a structural composite. Grout from the sleeves form bearing pads between adjacent elements and allow for load transfer within the structural composite. The exterior layers of the structural elements can be provided with simulative exterior surfaces, for example, with exterior surfaces simulating the appearance of structural logs.

19 Claims, 5 Drawing Sheets

CAST LOG STRUCTURE

CROSS REFERENCE TO RELATED APPLICATIONS

This application is a continuation-in-part of application Ser. No. 09/953,678, filed Sep. 15, 2001 now U.S. Pat. No. 6,851,233. The disclosure of this application is hereby incorporated by reference in its entirety, including all figures, tables, and drawings.

FIELD OF THE INVENTION

The invention relates generally to structures composed of log elements. Specifically, the invention relates to structures composed of cast log elements that provide enhanced appearance, structural integrity, insulative properties, and ease of assembly.

BACKGROUND OF THE INVENTION

Log structures have been instrumental in the history of many cultures. As a result, such structures have become symbolic in many places, going beyond mere shelter and into the realm of cultural icon. Log structures, specifically log homes, have therefore become desirable due not only to their natural beauty, but because of their historical and cultural feel as well.

Unfortunately, log construction is not particularly well adapted to modern building standards. Log structures are often dark and closed-in by modern standards, and have a tendency to "settle" as the logs age. Furthermore, log construction fails to provide the insulation values available in standard modern construction methods.

It can thus be expected that the improvement of log structures, and the emulation of certain aspects of log structures using alternative materials, has been the subject of inventive activity. For example, U.S. Pat. No. 4,503,648 to Mahaffey is directed to a lightweight composite building module capable of being readily attached to other correspondingly shaped modules for providing a wall of a building. The module includes a pair of spaced elongated wooden side boards joined by a wooden top board. The side boards have right angle cutouts removed from the inside corners thereof producing upper and lower horizontally extending ledges. Polyurethane foam is provided in the cavity defined by the side boards and top boards with said foam extending below the lower horizontally extending ledges. Elongated wooden bolts extend between the top boards of adjacent stacked modules drawing said modules tightly together under compression so that the top board of the next lower module compresses the foam extending below the lower horizontally extending ledges of the module carried directly therebelow producing a rigid sealed joint therebetween.

U.S. Pat. No. 5,163,259 to Hunsaker et al. discusses a modular building component made of solid wood, capable of being fitted onto other correspondingly shaped modules to provide a wall of a building. The module includes a core made of horizontally laminated wood with a lengthwise groove cut along the top and vertically at one end for utility purposes, to which side boards are attached in a manner which allows each module to lock into adjoining modules both vertically and horizontally. The upper edges of side boards are attached a short space from the top of the core, the lower edges extending past the bottom of the core, creating both a male and female fitting for adjoining modules. In the same manner side boards are offset a short space from one end of the core and extend past the core at the opposite end to allow the ends of modules to lock as well. The side boards are attached at the factory with adhesive bonding material and secured with fasteners. To form walls, the modules are stacked a row at a time and locked together using adhesive and metal fasteners for which holes have been pre-drilled in the laminated cores.

In another example, U.S. Pat. No. 4,433,519 to Jenkins shows a hollow cylindrical prefabricated modular construction element formed by generally circular supports and a sheath. These hollow cylinders are connected, using simple carpentry tools, at a building site to create walls, having a simulated log appearance.

U.S. Pat. No. 4,288,954 to O'Donnell is directed to simulated log siding in which wire metal lath is shaped to the generally semicircular configuration associated with a length of log used in a log wall structure. Several layers of cement-plaster are applied to the metal lath to waterproof it, and to lend texture and color to it. The effect of the layered and colored cement-plaster is to render the appearance of an actual log with its bark in place. A simulated log wall siding is made up of multiple lengths of such cement-plaster coated, simulated logs.

U.S. Pat. No. 3,552,079 to Mortensen discusses a building element including a panel-shaped insulating material extending between two timber half-beams, the whole element being formed as a beam with one or more tongues and grooves and with the insulating material extending in the full height of the beam from the bottom of a groove or surface between two tongues to the opposite edge of the beam, and an angle joint between two walls made of building elements having notches round a neck section for mutual connection of the elements.

While each of these patents show some advantages, it can be seen from the foregoing that the need exists for a simple, inexpensive construction system that provides the aesthetic advantages of log structures without sacrificing the functional advantages of modern building practices and materials.

All patents, patent applications, provisional patent applications and publications referred to or cited herein, are incorporated by reference in their entirety to the extent they are not inconsistent with the explicit teachings of the specification.

SUMMARY OF THE INVENTION

A structural system includes a plurality of pre-cast structural elements. Each of the elements includes an interior layer and an exterior layer cast of cementitious material, and an insulating layer between the interior layer and the exterior layer. The pre-cast structural elements are stacked adjacent to one another to form a wall. As the structural elements are stacked, respective cushions are placed between adjacent structural elements. The cushions create airspaces such that there is no direct surface contact between adjacent structural elements. Stacked elements are tied together with poured grout sleeves to create a composite structure. Grout from the sleeves form bearing pads between elements. These grout sleeves and pads allow for lateral and gravity force transfer throughout the composite. The exterior layers of the structural elements can be provided with simulative exterior surfaces, for example, with exterior surfaces simulating the appearance of structural logs.

DETAILED DESCRIPTION OF THE INVENTION

Figure 1:
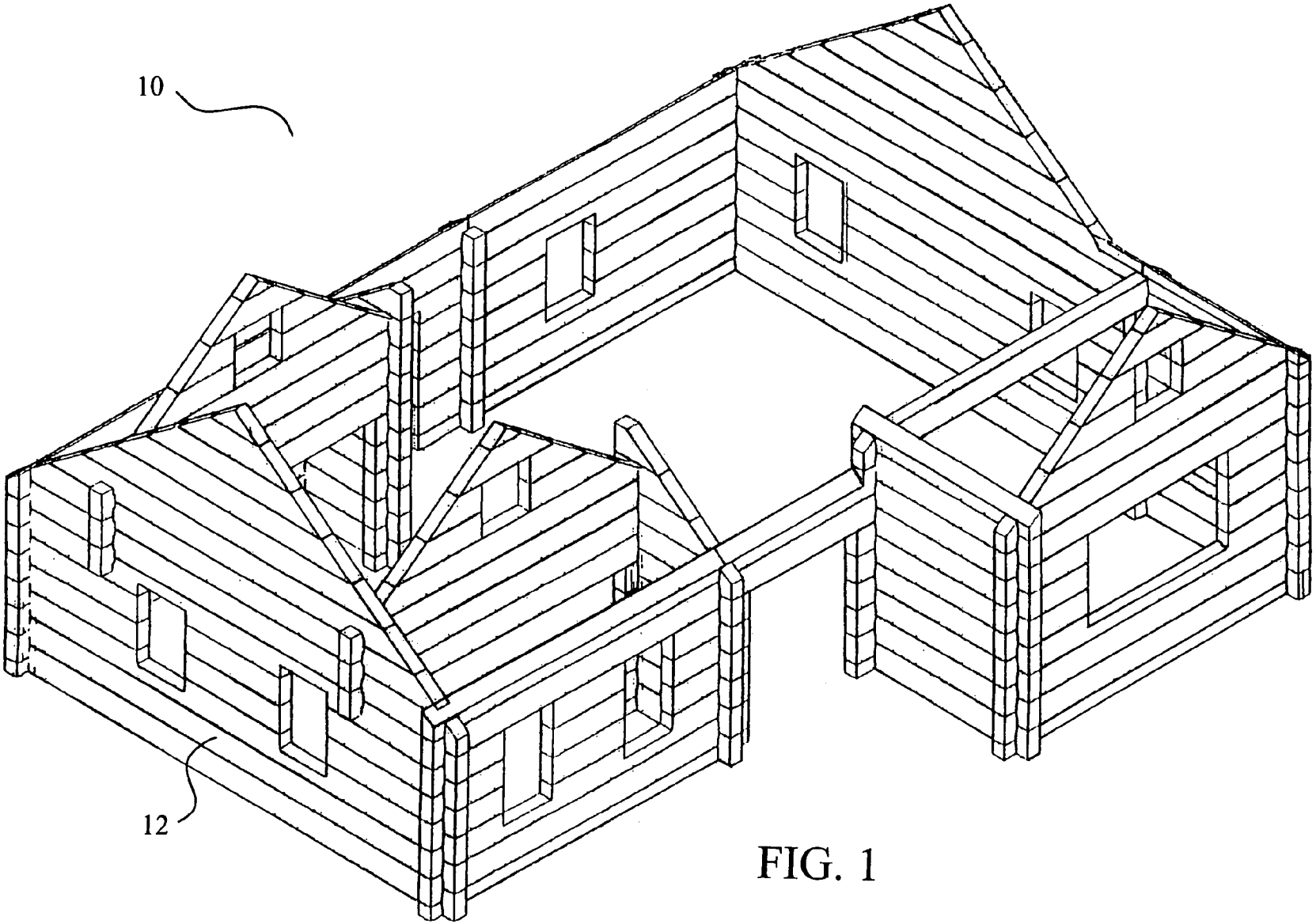
FIG. 1 is a schematic perspective view of a structure in accordance with the principles of the present invention.

A structure 10 in accordance with the principles of the present invention is shown in FIG. 1. The structure 10 includes a plurality of walls 12 having the external appearance of a traditional wooden log home.

Figure 2:
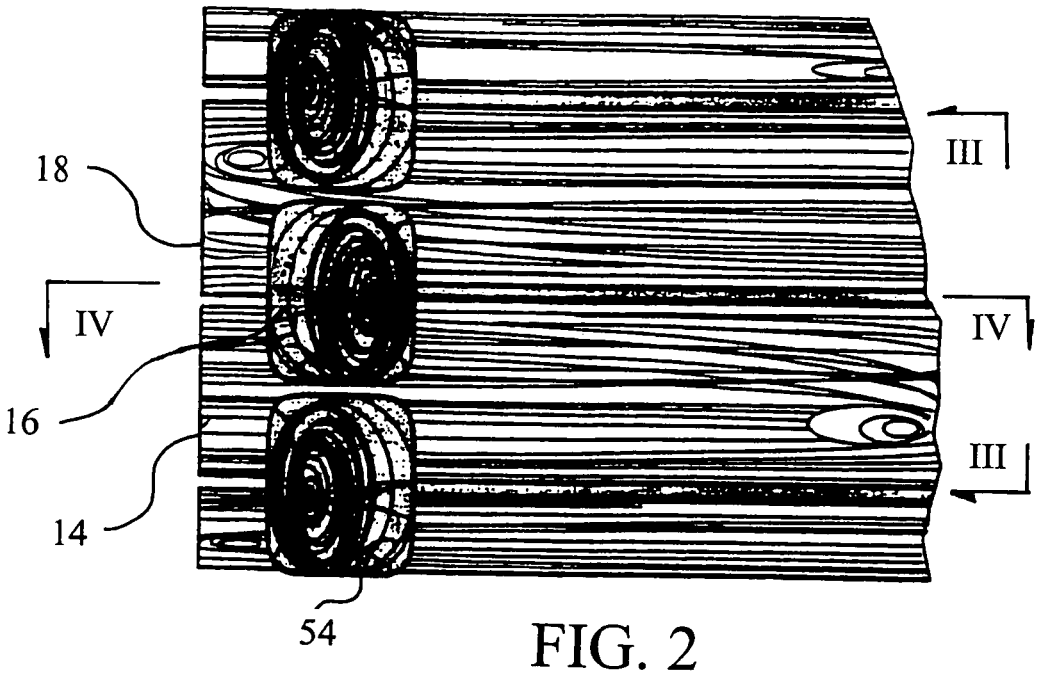
FIG. 2 is a detailed elevational view of the structure shown in FIG. 1.

Each wall 12 of the structure 10 is made up of a plurality of structural elements, joined together as are structural elements 14, 16, and 18 shown in FIG. 2. The structural elements 14, 16, and 18 are assembled in such a way as to simulate the appearance of structural logs, with their visible faces and ends molded to resemble log surfaces. The structural elements provide this appearance while providing insulative and structural properties unattainable with traditional log construction. This is accomplished by the construction details of each structural element.

Figure 3:
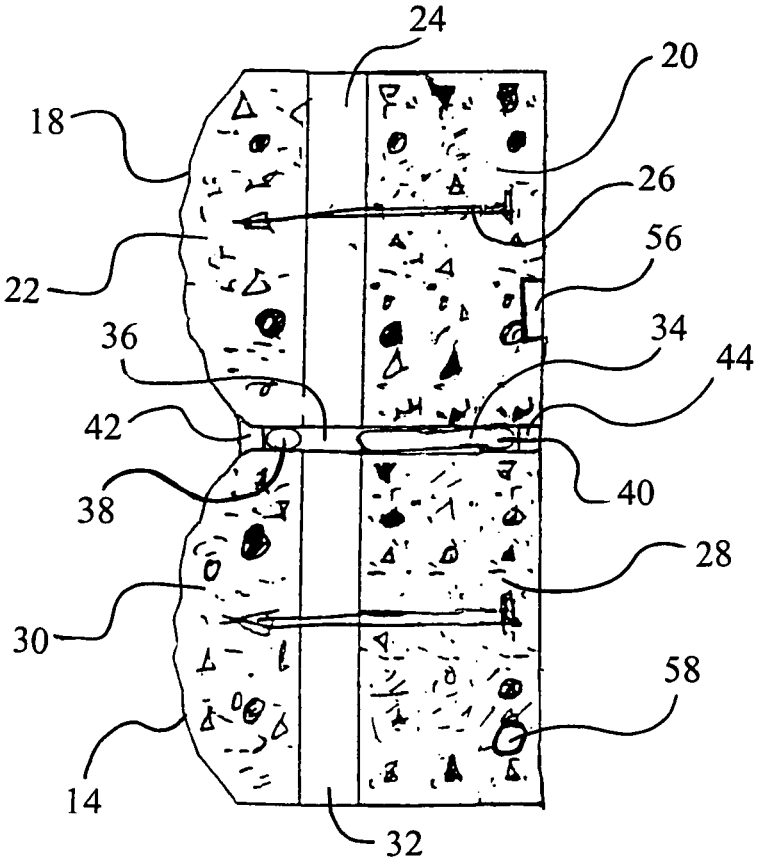
FIG. 3 is a sectional view taken generally along lines III-III in FIG. 2.

As seen in FIG. 3, the structural element 18 includes an interior layer 20, and exterior layer 22, and an insulating layer 24 between the interior layer 20 and the exterior layer 22. The interior layer 20 and the exterior layer 22 can be fabricated by being cast from a cementitious material, such as concrete, and can be held together in a conventional manner, such as by connector rods 26. One example of a suitable connection arrangement is shown in U.S. Pat. No. 5,519,973 to Keith, the specification of which is incorporated by reference herein. The insulating layer 24 can be fabricated from any known, suitable insulation material used in concrete paneling systems, such as Dow Chemical's Thermomass System, Owens-Corning's Pink Core Panel System, FabCor's Panel tie system, etc.

The structural elements 14 includes an interior layer 28, and exterior layer 30, and an insulating layer 32 between the interior layer 28 and the exterior layer 30. The interior layer 28 and the exterior layer 30 can be fabricated by being cast from a cementitious material, such as concrete, and can be held together in a conventional manner, such as by connector rods as described previously. The insulating layer 32 can be fabricated from any known, suitable insulation material as previously mentioned.

A cushion or shim 34 is located between the first structural element 14 and the second structural element 18. The cushion 34 creates an airspace 36 such that there is no direct surface contact between the adjacent structural elements 14, 18. Undesigned contact between adjacent structural elements creates point loading which causes the concrete elements to crack. Preferably, cushions are placed near the ends of each element and are place directly over one another. This provides temporary spacing for each structural element in the stack and insures that each element supports no more than its own weight. Cushions or shims can be made of any non-compressible material including, but not limited to, metal and plastic. In a preferred embodiment, the shims are four inch by four inch square non-compressible rubber disks.

In an alternate embodiment, the cushion 34 includes first and second elongated, resilient cushion elements, 38, 40 extending along a length of the structural elements 14, 18. The first cushion element 38 is secured between the exterior layer 30 of the first structural element 14 and the exterior layer 22 of the second structural element 18. The second cushion element 40 is secured between the interior layer 28 of the first structural element 14 and the interior layer 20 of the second structural element 18.

Flexible synthetic chinking material 42 can be applied between the exterior layer 30 of the first structural element 14 and the exterior layer 22 of the second structural element 18 at a position outside of the first cushion element 38. Fill material 44, which can be identical to the chinking material 42, can be applied between the interior layer 28 of the first structural element 14 and the interior layer 20 of the second structural element 18.

Figure 4:
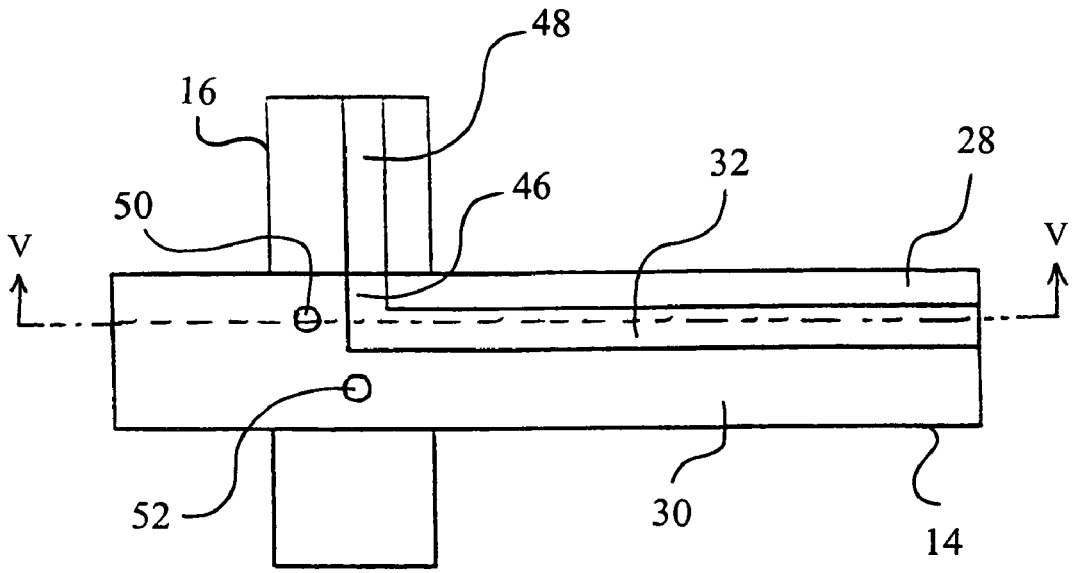
FIG. 4 is a sectional view taken generally along lines IV-IV in FIG. 2.

As seen in FIG. 4, the insulating layers of the structural elements can be provided with angled portions to provide a substantially continuous layer of insulation between the interior and the exterior of the structure. Here, the insulating layer 32 of the structural element 14 is provided with an angled 46, which aligns with an insulating layer 48 of the structural element 16.

Figure 5:
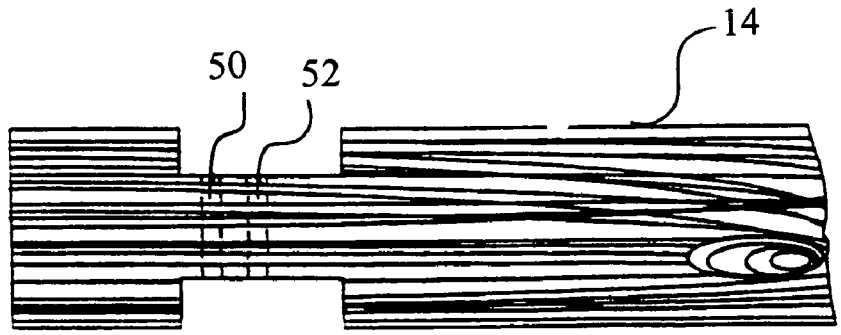
FIG. 5 is a detailed elevational view of a structural element in accordance with the principles of the present invention.
Figure 6:
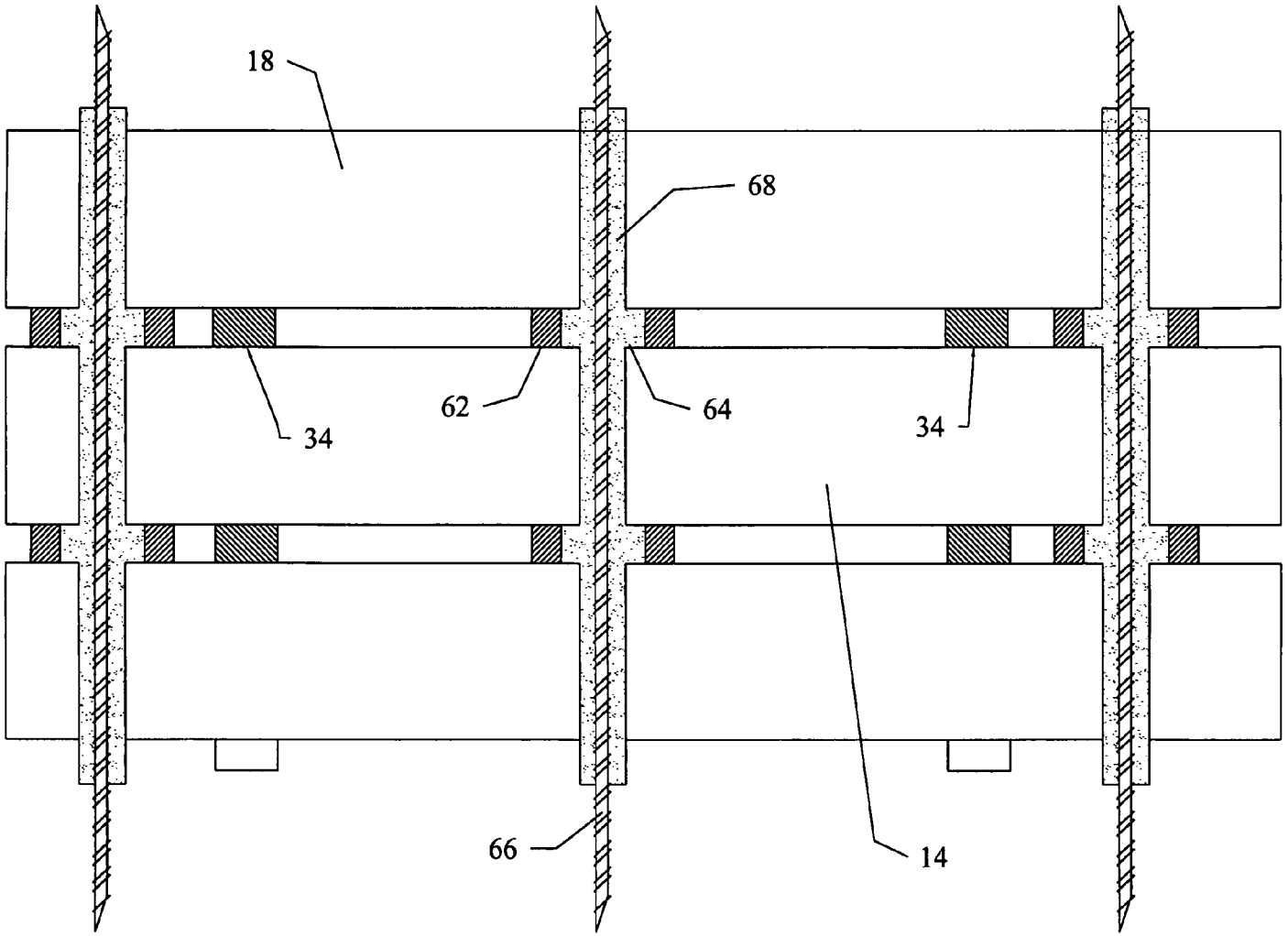
FIG. 6 is a sectional view taken along V-V of FIG. 4.
Figure 7:
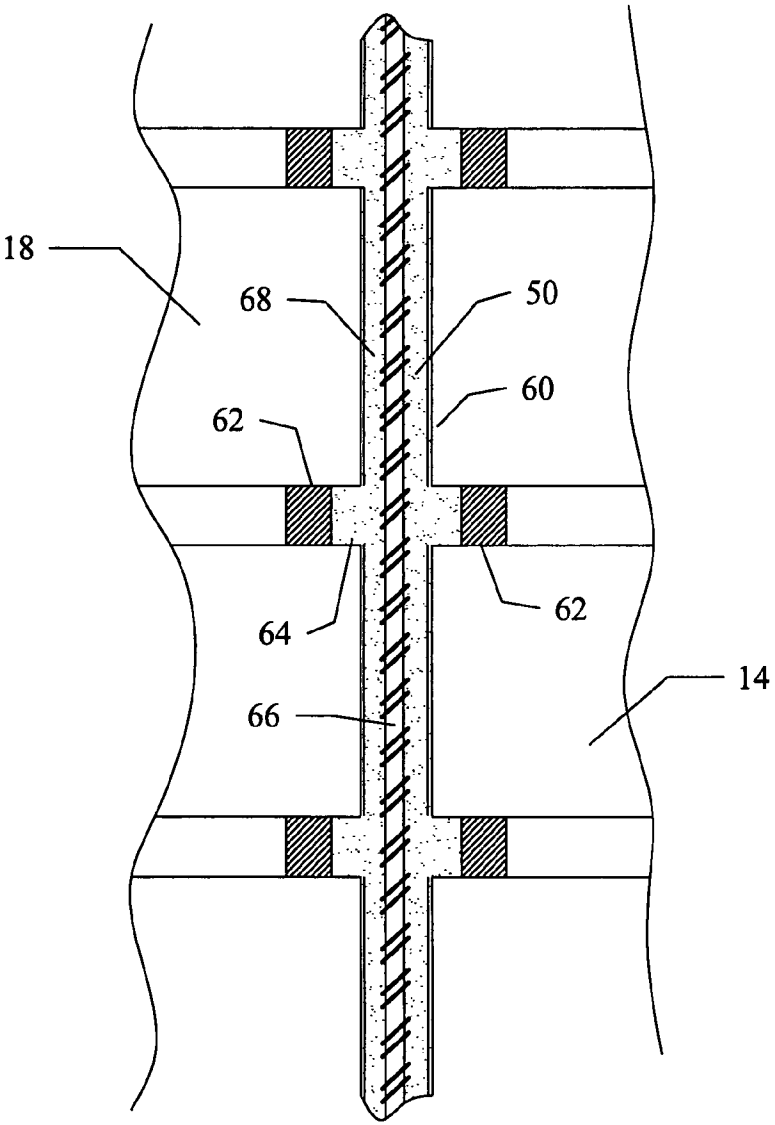
FIG. 7 is a detailed view of a portion of FIG. 6.

The structural elements are secured together at bearing points, here illustrated as grout sleeves 50, 52 extending through the corner joints of the structural elements (FIGS. 4 and 5). One skilled in the art would be aware however of the necessary placement of these bearing points along the wall of a composite structure. The grout sleeves 50, 52 extend vertically through the structural elements. Vertical reinforcing steel bars 66 are placed into the aligned grout sleeves and extend to the foundation of the structure, after which high-strength grout 68 is poured into the sleeves to encase the rebar and permanently tie the structural elements together into walls.

Grout sleeves 50, 52 are formed within the pre-cast layers and preferably the interior, structural layer 28 with pipe material. Piping can be any suitable material including metal pipe and polyvinyl chloride pipe. Sleeve 50 in element 14 is aligned with sleeve 60 in element 18. In a particularly preferred embodiment, a malleable gasket 62 is placed between adjacent elements around the sleeves of each element. When high strength grout is poured or pumped into the aligned sleeves, the gasket dams the grout to form a positive load bearing pad 64. The grout sleeves and bearing pads address tension and shear stress experienced by the composite structure from, for example, high winds or seismic activity. Additionally, the grout sleeves and bearing pads provide gravity load bearing throughout the structure compensating for, for example, a heavy roof snow load. The subject system therefore resists all forces addressed by present day building codes.

The interior and exterior layers of the structural elements can be fabricated from cast concrete material, and can be provided with simulative exposed surfaces. In the illustrated embodiment, the exterior surfaces of the structural elements simulate the appearance of hand-hewn structural logs, including end surfaces 54 (FIG. 1). It is also anticipated that the exterior surfaces could be fabricated to simulate round logs, or any other desired horizontal structural element, and that the simulated log surfaces can be textured and stained to simulate stripped logs or logs with the bark left on. Similarly, the interior surfaces of the structural elements can be fabricated to simulate log surfaces, wood paneling, stone, sheetrock, or any desired texture, and can te stained or painted to any suitable interior finish. The structural elements can be fabricated using rubber molds made from actual timbers, logs, paneling, stones, etc. using rubber molds in a generally known manner. Companies from which such molds are available in other configurations include Symons, Burke, Scofield, and Scott. Electrical and heating conduits 56, 58 can be cast in the wall during fabrication to avoid surface mounting.

Walls assembled in accordance with the principles of the present invention are nearly 100% insulated. It is contemplated that their energy efficiency will far surpass that of "real" log structures and other conventional building systems, due to their provision of an interior heat sink. The structural elements can be assembled on site using standard construction equipment in a manner similar to that used in traditional log construction.

Although the present invention has been described with reference to specific embodiments, those of skill in the art will recognize that changes may be made thereto without departing from the scope and spirit of the invention as defined by the appended claims.

The invention claimed is:

1. A structural system comprising the following:

a first pre-cast structural element including an interior layer cast from a cementitious material, an exterior layer cast from a cementitious material, an insulating layer between the interior layer and the exterior layer, the insulating layer substantially completely isolating the interior layer from the exterior layer, and at least one sleeve;

a second pre-cast structural element including an interior layer cast from a cementitious material, an exterior layer cast from a cementitious material, an insulating layer between the interior layer and the exterior layer, the insulating layer substantially completely isolating the interior layer from the exterior layer, and at least one sleeve;

at least one cushion between the first and second structural elements creating airspace such that there is no contact between the first and second structural elements; and at least one gasket between the first and second structural elements, the at least one gasket between and surrounding the at least one sleeve of the first pre-cast structural element and the at least one sleeve of the second pre-cast structural element which are aligned;

wherein grout poured into the at least one sleeve of the first pre-cast structural element and the at least one sleeve of the second pre-cast structural element forms a grout sleeve to secure the first pre-cast structural element to the second pre-cast structural element and creates a grout bearing pad to provide force transfer between the first pre-cast structural element and the second pre-cast structural element.

2. The structural system of claim 1, wherein said exterior layer of said first element and said exterior layer of said second element are provided wit simulative exterior surfaces.

3. The structural system of claim 2, wherein said exterior layer of said first structural element and said exterior layer of said second structural element are provided with exterior surfaces simulating the appearance of structural logs.

4. The structural system of claim 1, further comprising at least one connector rod in each of the first and second structural elements, the connector rods securing the interior layer to the exterior layer.

5. The structural system of claim 1, wherein said at least one cushion comprises at least one elongated resilient cushion member extending along a length of the first and second structural elements.

6. The structural system of claim 5, wherein said at least one cushion comprises first and second cushion elements.

7. The structural system of claim 6, wherein said first cushion element is secured between said exterior layer of said first structural element and said exterior layer of said second structural element, and said second cushion element is secured between said interior layer of said first structural element and said interior layer of said second structural element.

8. The structural system of claim 1, wherein said at least one cushion is a non-compressible disk.

9. The structural system of claim 8, wherein the insulating layers of the first and second structural elements are fabricated from an expanded plastic material.

10. The structural system of claim 1, further comprising a chinking material between said exterior layer of said first structural element and said exterior layer of said second structural element at a position outside of said at least one cushion.

11. The structural system of claim 1, wherein the insulating layers of the first and second structural elements are fabricated from an expanded plastic material.

12. A structural system comprising the following;

a plurality of pre-cast structural elements, each of the elements including an interior layer cast from a cementitious material, an exterior layer cast from a cementitious material, an insulating layer between the interior layer and the exterior layer, the insulating layer substantially completely isolating the interior layer from the exterior layer, and at least one sleeve, the structural elements being stacked adjacent to one another to form a wall such that the sleeves are aligned;

at least one respective cushion between adjacent structural elements, the cushions creating airspace such that there is no direct surface contact between adjacent structural elements;

at least one gasket between the first and second structural elements, the gasket between and surrounding the aligned sleeves of adjacent, stacked structural elements;

wherein grout poured into the sleeves creates a grout sleeve securing adjacent, stacked structural elements to one another and forms a grout bearing pad providing force transfer between adjacent structural elements.

13. The structural system of claim 12, wherein the exterior layers of the structural elements are provided with simulative exterior surfaces.

14. The structural system of claim 13, wherein the exterior layer of the structural elements are provided with exterior surfaces simulating the appearance of structural logs.

15. The structural system of claim 12, wherein the interior layers of the structural elements are provided with planar interior wall surfaces.

16. The structural system of claim 15, wherein each at least one respective cushion comprises first and second cushion elements.

17. The structural system of claim 16, wherein said first cushion element is secured between the exterior layers of adjacent structural elements, and said second cushion element is secured between the interior layers of adjacent structural elements.

18. A method of assembling a structural composite, the method comprising the steps of:

providing a plurality of pre-cast structural elements, each of the elements comprising an interior layer cast from a cementitious material, an exterior layer cast from a cementitious material, an insulating layer between the interior layer and the exterior layer, the insulating layer substantially completely isolating the interior layer from the exterior layer, and at least one sleeve, the at least one sleeve of each element aligning with the at least one sleeve of adjacent structural elements;

placing at least one respective cushion between adjacent structural elements, the at least one cushion creating airspace such that there is no direct surface contact between adjacent structural elements;

placing at least one respective gasket around and between the aligned sleeves of adjacent structural elements;

stacking the structural elements adjacent to one another to form a wall; and pouring grout into the sleeves of adjacent, stacked structural elements forming a grout sleeve to secure adjacent, stacked structural elements to one another creating a composite, and forming grout bearing pads providing force transfer between adjacent, stacked structural elements.

19. The method of claim 18, wherein the step of providing a plurality of structural elements comprises casting the exterior layers of the structural elements from cast concrete material to resemble structural log elements.

* * * * *